United States Patent [19]

Thomas

[11] Patent Number: 4,599,760

[45] Date of Patent: Jul. 15, 1986

[54] SHOE BUFFING MACHINE

[76] Inventor: John Thomas, 2615 S. Calhoun Rd.—Apt. #108, Bldg. 4, New Berlin, Wis. 53151

[21] Appl. No.: 567,505

[22] Filed: Jan. 3, 1984

[51] Int. Cl.[4] ..... A47L 23/02

[52] U.S. Cl. ..... 15/31; 15/33

[58] Field of Search ..... 15/31, 33, 36, 37, 30, 15/97 A

[56] References Cited

U.S. PATENT DOCUMENTS

| | | | |
|---|---|---|---|
| 693,531 | 2/1902 | McKee et al. | 15/37 |
| 854,407 | 5/1907 | Christenson | 15/33 |
| 1,051,387 | 1/1913 | Burkhart | 15/97 A |
| 1,551,387 | 8/1925 | Gross | 15/33 X |
| 1,887,906 | 11/1932 | Spruill | 15/31 |
| 2,607,938 | 8/1952 | Douglass | 15/97 A |
| 3,339,219 | 9/1967 | Bast et al. | 15/31 |

FOREIGN PATENT DOCUMENTS

| | | | |
|---|---|---|---|
| 505007 | 2/1931 | Fed. Rep. of Germany | 15/31 |
| 1914202 | 10/1970 | Fed. Rep. of Germany | 15/30 |

*Primary Examiner*—Philip R. Coe
*Assistant Examiner*—Frankie L. Stinson
*Attorney, Agent, or Firm*—Ronald E. Barry

[57] ABSTRACT

A shoe polishing machine including a replaceable buff assembly to enclosingly engage the outer surface of a shoe, mechanism for producing relative vibratory motion between said buff assembly and a shoe positioned in said buff assembly. A button actuated mixing and spraying assembly for spraying polish on the buff assembly and the buff assembly including a polishing cloth for easy and economical replacement. The shoe buffing machine being adaptable for automatic operation on payment of a fee for use in public places including an electrical circuit for the automatic operation.

10 Claims, 20 Drawing Figures

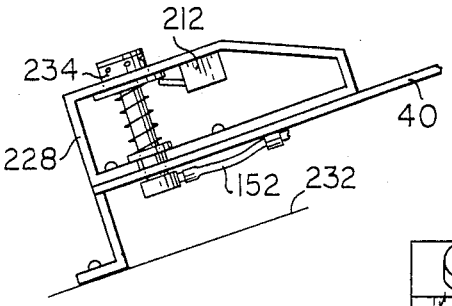
FIG.19
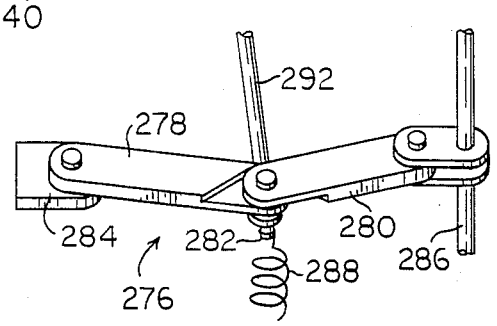
FIG.18
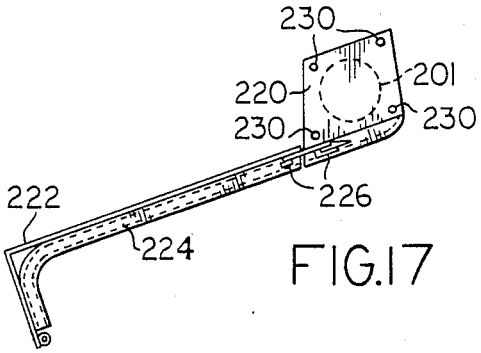
FIG.17
FIG.16
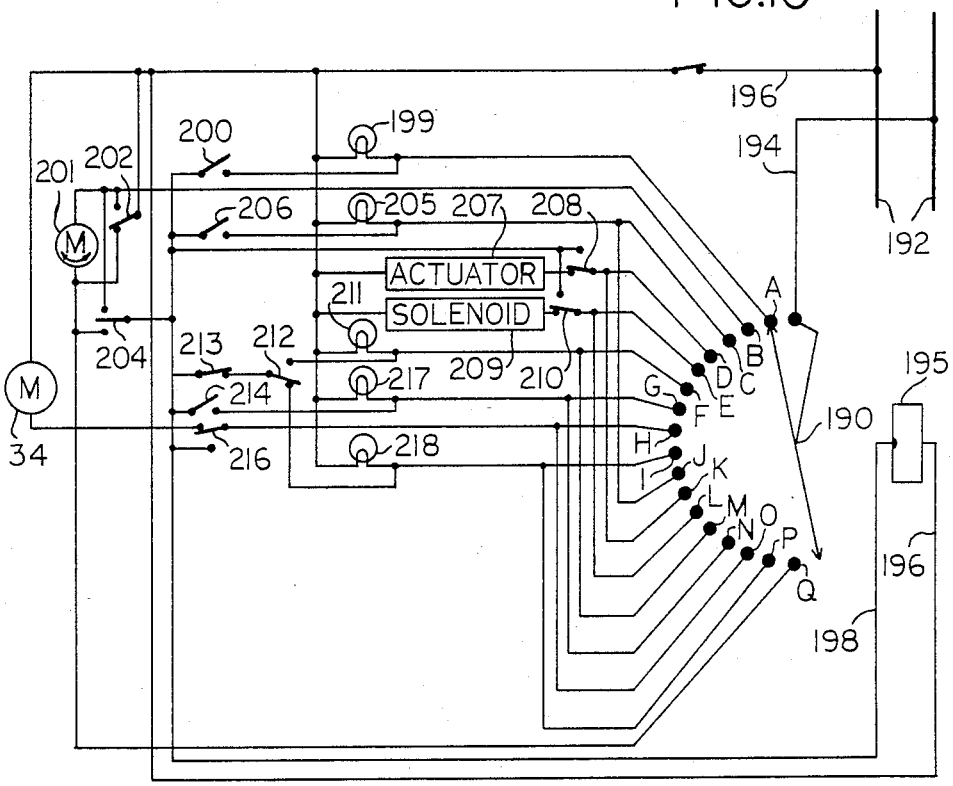

SHOE BUFFING MACHINE

BACKGROUND OF THE INVENTION

Shoe shining is done primarily for two purposes, to make the shoe look good and to protect the leather for long life. There are a variety of shoe polishing or shoe shining machines in existence now. They are either for coin operated service or for household use. None of these machines give a satisfactory shoe shine operation covering the complete shoe surface, except the hand-held type with a rotating brush which makes the operation practically manual. All of these machines operate on the principle of guiding one or more rotating or reciprocating brushes on the shoe surface either mechanically or by moving the shoe. All of these are limited in their capability and most of these are very complex in construction and operation to be used as a household machine. Those which are in use have no usable capability for application of polish without staining the sock or surroundings. Further, provision for polishing shoes with different colors is limited and unsatisfactory. These are the reasons why even today the shoe polishing operation is primarily done manually at home as well as in public places.

SUMMARY OF THE INVENTION

The present invention provides a shoe buffing, shining or polishing machine which operates on a principle entirely different from the traditional methods and polishes the entire surface of the shoe in a short period of time producing a shine superior to that produced by brushes. This invention provides for polishing a shoe independently or on foot while protecting the sock from polish stain. The machine can be in the form of a simple and compact portable machine for household use. The complete shoe polishing can be done inside the machine, thus leaving surroundings clean. The machine can be easily modified for coin operated service in public places. Basically, this machine works on the principle of covering the shoe surface with a buffing means such as a buffing cloth or the like after either the buffing means or a shoe surface has been applied with polish, and then producing relative rubbing motion between the buffing means and the shoe surface with pressure induced between the shoe surface and the buffing means. Provisions are in the machine for easy change of the buffing means for replacing the worn out buffing means. Provisions are provided for applying different colored polish or other shoe dressing or conditioning preparations such as wax and a variety of other shoe surface coating means available in the market, within the machine. This machine can be used as a foot massage machine by replacing the buffing means with a massage pad.

IN THE DRAWINGS

FIG. 16 is a schematic electrical circuit diagram for the coin controlled buffing machine.

FIG. 17 is a side elevation view of the rolling door support panel and the rolling door assembly locked together.

FIG. 18 is a perspective view of the linkage for closing and opening the buff assembly in the coin controlled buffing machine.

FIG. 19 is a side elevation view of the shoe support with spray nozzle and shoe sensing switch for the coin controlled machine.

DESCRIPTION OF THE INVENTION

Figure 1:
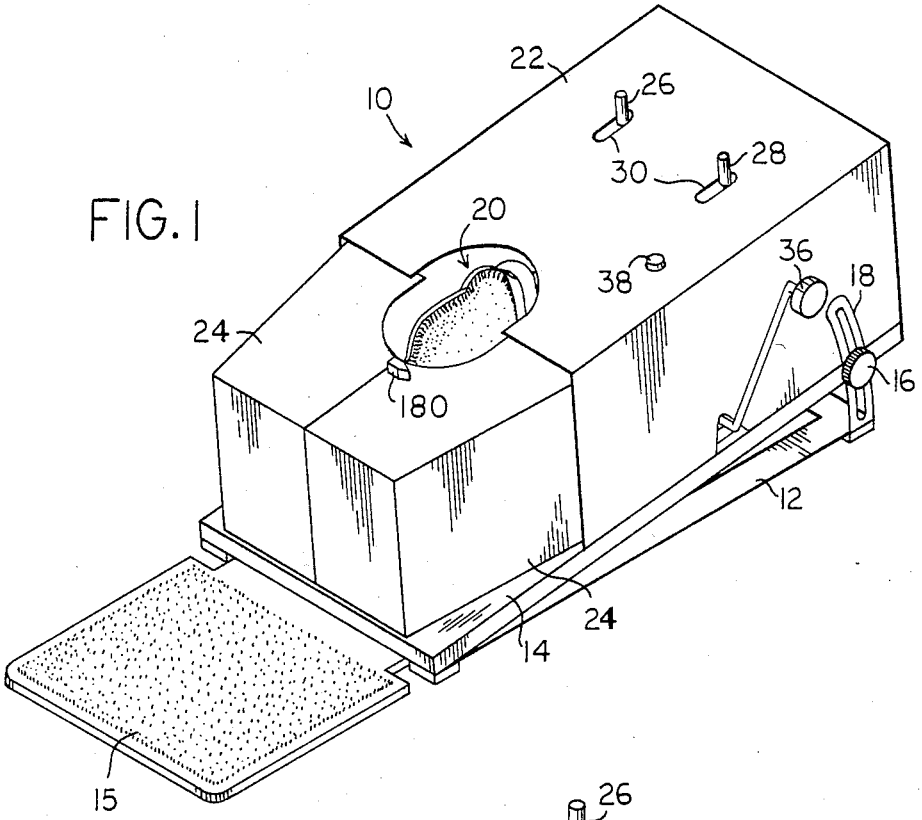
FIG. 1 is a perspective view of a household-type shoe buffing machine according to the invention.
Figure 2:
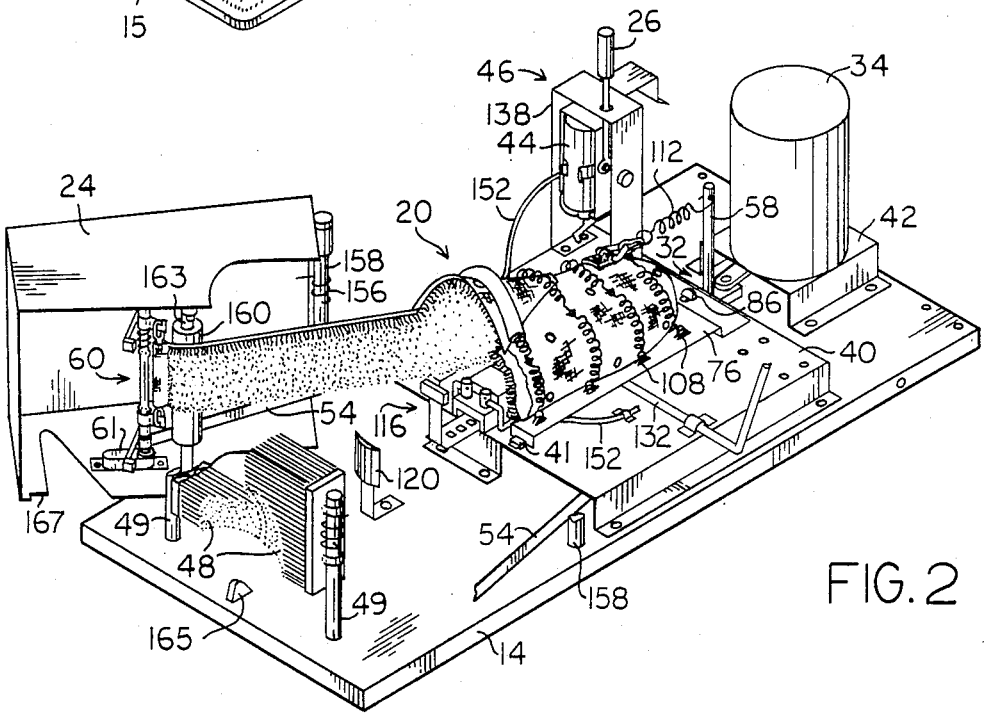
FIG. 2 is a perspective view of the shoe buffing machine with one of the doors and some of the parts removed for clarity.

Referring to FIGS. 1 and 2 of the drawings, the shoe buffing machine 10 generally includes a support structure which as shown includes a support frame 12 having a support base or panel 14 pivotally mounted on the frame. The angular relation of the base 14 to the frame 12 is set by means of a set screw 16 on either side of the base which cooperates with a slotted support member 18 to hold the base at any predetermined angle convenient to the user. A shoe buff member in the form of a shoe buff assembly 20 is housed within a cover or hood 22 pivotally attached to the base 14 and enclosed by means of a pair of doors 24 pivotally mounted on the base 14. In the closed position, the recesses in doors 24 and in cover 22 together form an opening for the leg. The shoe dressing preparation including polish and wax of different colors to be applied to the shoes is selected by means of buttons 26 and 28 which project through slots 30 provided on the top of the cover 22. The shoe buff assembly 20 is connected to a vibrating assembly 32 which is vibrated by means of a motor 34 to buff a shoe. In use, polish is applied on the shoe or the buff assembly 20, the doors 24 are opened, and a shoe is inserted into the shoe buff assembly 20. The doors 24 are closed and an operating handle 36 is pulled up to set the shoe against the shoe buff assembly, as described hereinafter. The motor 34 is started by pushing button 38 located on the top of the machine. The mat 15 connected to the base can be used for cleaning the sole of the shoe.

More particularly and referring to FIG. 2, the base 14 is shown with one of the doors 24 open and the other door 24 removed to show the shoe buff assembly 20. The shoe buff assembly is shown partially removed to show the parts inside. The shoe buff assembly is mounted on a panel 40 secured to the top of the base 14. The base 14 with other supports such as panel 40 attached to it forms a base structure. The motor 34 is mounted on a bracket 42 secured to the base 14 leaving a gap between the bracket 42 and the panel 40. Polish is dispensed from a polish container 44 supported by means of a polish mixing assembly 46 mounted on the panel 40. Although only one mixing assembly 46 is shown, it should be understood that a second assembly can be mounted on the opposite side of the panel 40 and more mixing assemblies can be mounted on the base structure. Dust can be removed from the shoes by means of a pair of brushes 48 pivotally mounted and spring controlled on posts 49 at the shoe entry end of the shoe buff assembly 20.

Figure 3:
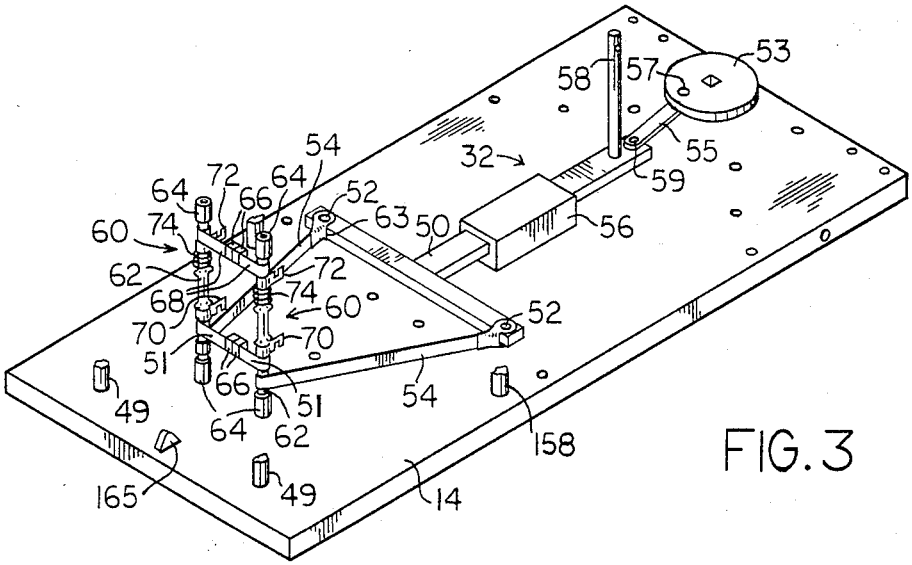
FIG. 3 is a perspective view of the vibrating assembly for the shoe buffing machine mounted on the base.

Referring to FIG. 3, a structure means in the form of a frame assembly 32 which is used to vibrate the shoe buff assembly 20 is shown mounted on the base 14. In this regard the vibrating assembly 32 includes a main vibrating or reciprocating element 50, and a pair of arms 54. The vibrating element 50 is supported on the base 14 by means of a linear bearing 56. The arms 54 are pivotally connected to the vibrating element 50, by means of pins 52 such that the opening and closing of the arms 54 will facilitate opening and closing of the buff assembly 20, as described hereinafter. A vertical post 58 is provided toward the forward end of the vibrating element 50 and a pair of vertical post assemblies 60 are provided at the free ends of the arms 54.

The vibrating assembly 32 is vibrated by means of the motor 34 which is drivingly connected to the center of a disc 53 located within the motor support bracket 42. The disc 53 is connected to the element 50 by means of a connecting element 55 which has one end pivotally connected to the disc at a radial distance from the center by a pin 57 and the other end pivotally connected to the end of the element 50 by a pin 59. The rotary motion of the disc 53 is converted to linear reciprocating motion of the element 50 by means of the connecting element 55. Referring to FIG. 2, it should be noted that the vibrating frame assembly 32 is located under the panel 40 on the base 14, with the vertical post 58 projecting upwardly in the space between the front edge of the panel 40 and motor support bracket 42. The support post assemblies 60 are operatively connected to the doors 24.

In this regard, each of the post assemblies 60 includes a post 62 mounted at the end of each arm 54. Rollers 64 are provided at each end of each of the posts 62. Means in the form of magnets 66 are provided for holding the post assemblies in a closed position as seen in FIG. 3. The magnets 66 are mounted on the ends of lower arms 51 and upper arms 68 secured to the posts 62. It should be understood that these magnets 66 need not exert much magnetic force since this magnetic force is intended only to prevent rattling of the post assemblies 60, during the operation of the machine. A pair of lower hooks 70 restrained from upward motion are provided on the posts 62 above the lower arms 51. A second pair of hooks 72 are mounted on the posts 62 in an axially movable fashion, and are biased by springs 74 into engagement with the upper arms 68. All the hooks 70 and 72 are rotatably mounted on the posts 62. Angular motion of each of the arms 54 is limited by stop edge 63 provided on the pivot end of each of the arms 54 which engages the vibrating element 50 so that the magnet ends of the post assemblies 60 do not move unduly towards the other past its intended middle position.

The post assemblies 60 are secured to the doors 24 by means of guides 61 provided on the inside of the top and bottom of the doors. The rollers 64 are positioned in the guides 61 to allow the post assemblies to move with respect to the doors 24 when the doors are opened and closed, and the guides 61 will serve to prevent any undue sidewise motion of the post assemblies 60 during the buffing operation of the machine.

Figure 4:
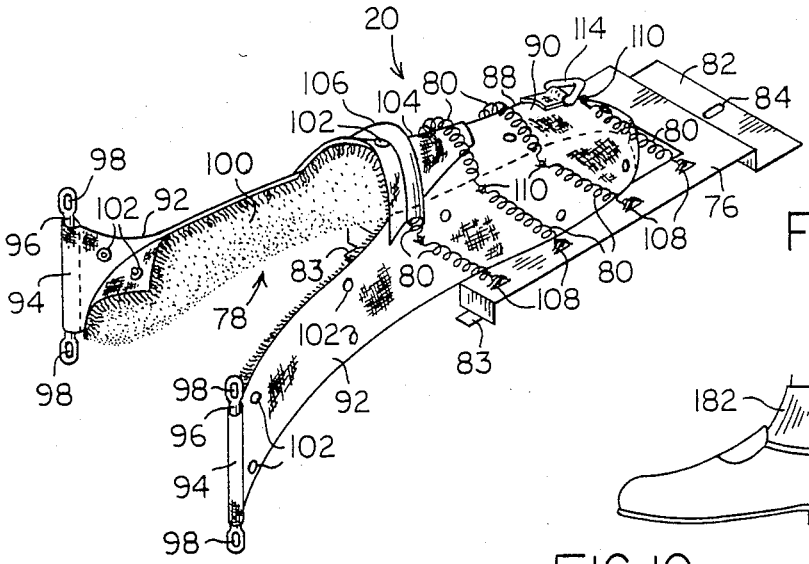
FIG. 4 is a perspective view of the shoe buff assembly.

Shoes are buffed by means of the shoe buff assembly 20 structured to flexibly engage the shoe surface and is mounted on the panel 40. Referring to FIG. 4, the shoe buff assembly 20 includes a buffing means assembly 78 and elastic means in the form of a number of springs 80 connected to it. The shoe buff assembly 20 is connected to a frame 76 by means of springs 80. The frame 76 includes a mounting flange 82 at the front end having an opening 84 which is adapted to be secured to the panel 40 by means of a lock 86, and a pair of tabs 83 at the rear end adapted to engage loops 41 on panel 40.

The buffing means assembly 78 includes a support pad 88 which is made of a flexible material, but stiff enough so as not to collapse under the load of the springs 80. An example of such material would be a thick fabric such as that used for belts. The support pad 88 includes a tapered forward section 90 having the shape generally of the toe of the shoe with the end being slightly open and a pair of arms or elongated ends 92 which extend rearwardly from the toe portion 90. Attaching means for operatively connecting the said arms 92 are formed by terminating the arms 92 at a pair of tubular sections 94 which house mounting support pins 96. An eye 98 is provided at each end of the pins 96. Buffing of the shoe is achieved by means of a buffing means in the form of a buffing cloth 100 secured to the inside of the support pad 88 by means of snap buttons 102.

The buffing means can be made from a variety of flexible buffing materials which can be stitched or formed to fit the interior of the support pad. Such materials are readily available in the marketplace. Some of these buffing materials in the fabric form are commonly known as fur lining and sherpa cloth and when used for buffing is called buffing cloth. Also, specially made fabrics for buffing are available in the marketplace. Special buffing materials having varying thicknesses can be made to engage different areas of the shoe surface with uniform pressure. Further, buffing materials impregnated with a variety of shoe shine preparations can be made whereby separate application of such preparation will not be required. These materials can be compared to a typewriter ribbon where the ink is transferred to a paper, the same ribbon being used over and over. It is to be noted that removable or fixed attaching means other than snap buttons 102 can be used to attach buffing means 100 to the support pad 88. The support pad 88 includes a sliding piece 104 at the start of the arms 92 of the support pad 88, covering a section of the buffing means over the lace portion of the shoe. The sliding piece 104 is free to slide over the arms 92 under the bias force of spring 80 which is enclosed in a flexible tube 106. This arrangement allows easy movement of the buffing means over the lace portion of the shoe while maintaining contact between buffing means and the shoe surface in this area. The sliding piece 104 can be made stiffer than the rest of the pad 88.

Figure 20:
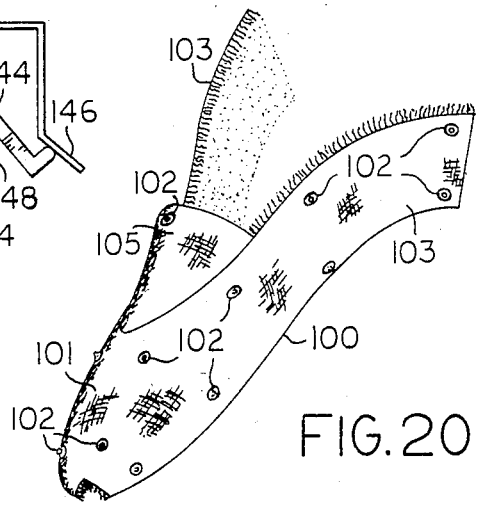
FIG. 20 is a perspective view of the buffing cloth.

Referring to FIG. 20, the buffing cloth 100 is shaped to fit the interior of the support pad 88 and includes a tapered forward portion 101 to engage the toe portion of the shoe and two rearwardly extending elongated ends 103 for engaging the sides and rear portion of the shoe. The buffing cloth 100 also includes a raised portion 105 to engage the lace area of the shoe and is shaped to operatively attach to the sliding piece 104 of the support pad 88. The buffing cloth 100 being more flexible than the pad 88, the raised portion 105 will fold and unfold under sliding piece 104 as it moves over the lace area of the shoe, always engaging the shoe surface during buffing operation of the machine.

The support pad is biased inward by means of the springs 80 to provide a slight pressure against the shoe surface and the buffing means flexibly engages the shoe surface during the buffing operation. The ends of springs 80 which are closest to the lower edge of the support pad 88 are anchored to loops 108 provided on the frame 76 on either side. The other ends of the springs 80 are anchored to loops 110 on the support pad.

The shoe buff assembly 20 with the frame 76 is removably mounted on the panel 40 by means of the lock 86. The toe end 90 is connected to the post 58 by elastic means in the form of a length adjuster spring 112 which is connected to a triangular ring 114 provided on the top of the toe portion 90 of the support pad 88. The spring 112 is stiff enough to assure forward motion of the support pad 88, and accommodates any substantial variation in the operating length of the buff assembly 20, operating length being defined as the length of the assembly 20 between the post assemblies 60 and the point of attachment of the triangular ring 114 in the operating position of the machine. The length adjuster spring 112 also facilitates easy accommodation of shoes covering a wide size range in the same buff assembly 20, while assuring excellent shine. The springs 80 in front of the triangular ring 114 helps to wrap the buffing means around the toe portion of the shoe when shoes of various sizes are used. The pins 96 are secured to the support post assemblies 60 on the vibrating frame assembly 32 by means of the hooks 70 and 72 which engage the eyes 98 on the pins 96. Thus the arms 92 of the support pad are opened when the doors 24 are opened to allow the user to insert a shoe into the shoe buff assembly 20, and closed when doors 24 are closed.

It should be noted that if a change of shoe dressing preparation including color is desired, the buff assembly 20 can be removed by turning lock 86 and releasing pins 96 from the hooks 70 and 72 and disconnecting spring 112 from the ring 114, and replaced by a second buff assembly 20 and a frame 76. Alternatively, the buffing cloth 100 can be replaced in the buff assembly 20 by a second buffing cloth to achieve the same end result. Also, the buff assembly 20 can be replaced after disconnecting the springs 80 from the frame 76. The buffing cloth can easily be replaced when worn out.

It should be understood that the resultant pulling force of the pad arms 92 of the support pad exerts a thrust force between arms 68 and between arms 51 of the post assemblies 60 through the magnets 66 during the backward motion of the buff assembly 20. This occurs because of the angular relationship tending to converge the arms 54 towards the post assemblies 60 in the closed position of arms 54 as seen in FIG. 3 and since the arms 92 of the pad 88 are brought together wrapping the rear portion of the shoe for the buffing position as described hereinafter. During the forward motion of the buff assembly, the ends of arms 92 of the pad 88 are loose and the magnets 66 prevent the separation of upper arms 68 and lower arms 51 of the post assemblies 60.

Figure 5:
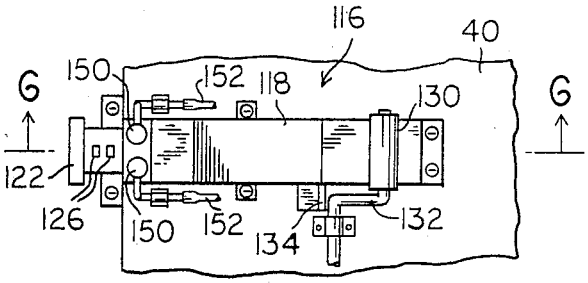
FIG. 5 is a top view of the shoe positioning assembly with the spray nozzle, excluding fixed heel support.
Figure 6:
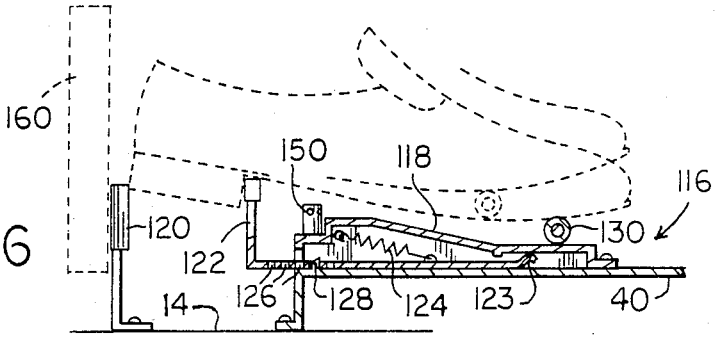
FIG. 6 is a partial sectional view in elevation taken along 6—6 of FIG. 5 showing the shoe positioning assembly, spray nozzle and the relative position of a shoe and one of the support rollers.

Means are provided for supporting and positioning a shoe within the shoe buff assembly 20. Such means is in the form of a shoe positioning assembly as seen in FIGS. 5 and 6. The shoe positioning assembly includes an adjustable heel stop assembly 116 mounted on the top of the panel 40 and a fixed heel stop 120 fixed on base 14. The adjustable heel stop assembly 116 includes a support cover 118 and an adjustable heel stop 122. The adjustable heel stop 122 is mounted within the support cover 118 and is guided by the side walls of the cover. The stop 122 which also forms the support for the backward portion of the shoe is biased toward the fixed heel stop 120 by means of a spring 124 connected between the stop 122 and the support cover 118. The adjustable heel stop 122 includes a number of openings 126 which are aligned with a tab 128 provided on the panel 40.

When the shoe is inserted into the machine, the heel must pass the fixed stop 120 for proper positioning. The forward edge of the heel of the shoe will engage the adjustable stop 122 forcing it forward. The heel portion of the shoe as it is moved forward with slight upward push will raise the adjustable stop 122 over the tab 128 and move it under the cover 118 against the bias of the spring 124. Shoe is moved forward until one of the openings 126 is aligned with the tab 128 while the back of the heel comes just in front of the fixed heel stop 120. The inclined relation of the spring 124 and engagement of the end 123 of the adjustable heel stop 122 with the support cover 118 with the level of engagement point between the heel and heel stop 122 being above the end 123, facilitate raising of the adjustable heel stop over the tab 128 during this procedure. Pressing the shoe down will engage the tab 128 in the opening 126. Holding the heel between the stops 120 and 122 facilitates relative rubbing motion between the buffing means and the shoe while operating the machine when the shoe is independently positioned in the machine, i.e. not worn on foot. The weight of the shoe and the biasing force of the springs 80 is sufficient to hold the heel between the stops 120 and 122 preventing raising of the adjustable heel stop 122 over the tab 128 during the vibratory motion of the buff assembly 20. When the buffing machine is modified to be used only when the shoe is worn as in the case of a coin-operated machine, the adjustable heel stop 122 is made in the form of a fixed shoe rest accommodating all size heels where the user keeps the shoe properly positioned.

The shoe is moved to a buff position by means of a roller 130 mounted on the end of a rod 132. The rod 132 is mounted on the top of the panel 40 and is operatively connected to the handle 36 located on the outside of the cover 22 (FIG. 1). The roller 130 is moved upward to raise the toe of the shoe into proper engagement with the buffing means under the toe portion 90 of the support pad 88 by pulling the handle 36 upward toward the operator after the shoe has been positioned between the fixed heel stop 120 and the adjustable heel stop 122. The front and back surfaces of the fixed heel stop are concavely shaped toward the back of the heel of a shoe positioned in the machine. The rod 132 comes to rest against the stop 134 on the side of the cover 118. Relative position of the shoe before and after raising the toe portion is shown in FIG. 6.

Figure 11:
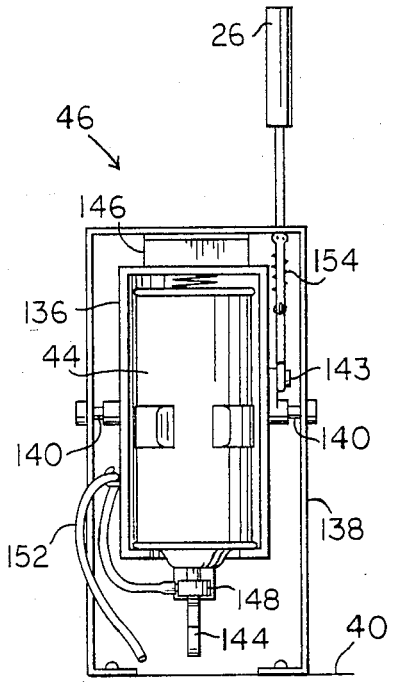
FIG. 11 is a front elevation view of the polish mixing assembly.
Figure 12:
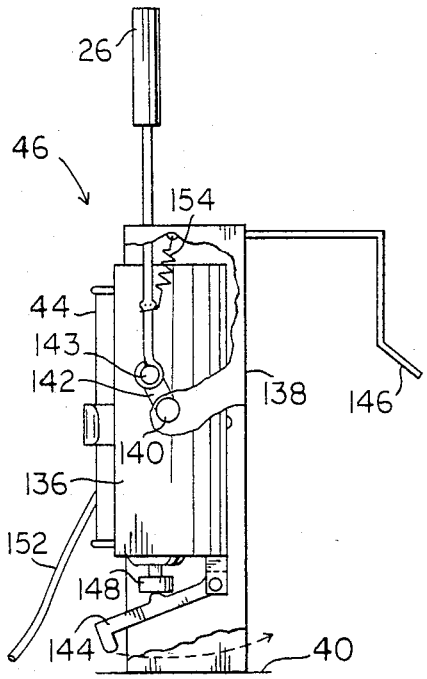
FIG. 12 is a side elevation view of the polish mixing assembly.
Figure 13:
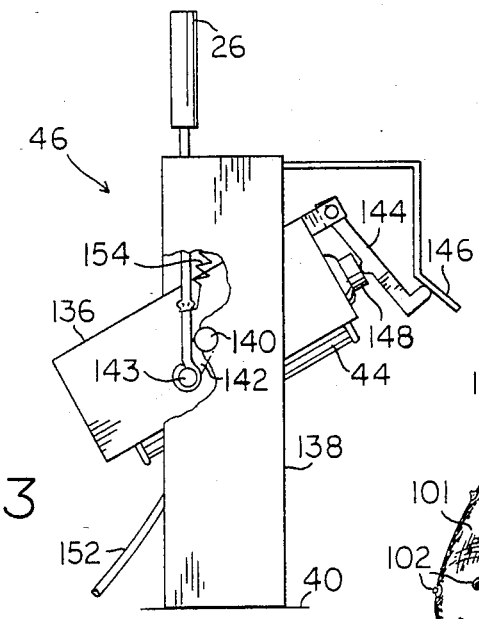
FIG. 13 is a view similar to FIG. 12 showing the polish container rotated in the mixing assembly with the nozzle in the actuated position.

To polish a shoe, polish is applied to the buffing means 100 prior to inserting the shoe into the machine by means of the buttons 26 and 28 after closing the doors 24. In this regard and referring to FIGS. 11, 12 and 13, the button 26 is shown connected to the mixing assembly 46 which is used to mix the polish or other shoe dressing preparations in the container 44 prior to applying the polish or the said preparations on the buffing means. The mixing assembly 46 includes a container holder 136 rotatably mounted in a fixed bracket 138 by means of pins 140. The button 26 is connected to a lever arm 142 which is secured to pivot pin 143 on the container holder 136 so that on depressing of the button 26, the container holder 136 will rotate about the axis of the pivot pins 140. The rotation of the container 44 will mix or agitate the content of the container before the polish is released.

Means are provided for releasing the content from the container 44. Such means is in the form of a lever arm 144 pivotally mounted on the container holder 136. When the container is rotated about the pin 140, the lever arm 144 will engage a fixed stop 146 forcing the lever arm 144 against the content release nozzle 148 on the container 44. The nozzle 148 can be in the form of an adaptor made to fit the nozzle on the spray cans readily available in the market. The nozzle 148 is connected to a spray head or spray nozzle 150 provided on the support cover 118 by means of a tube 152. The content of the container will be sprayed in all directions outwardly from the head 150 onto the buffing means 100. When the button 26 is released, the container holder 136 is rotated back to the original vertical position by means of a spring 154 operably connected to the button means 26. The two spray heads 150 are shown mounted on the cover 118 to accommodate two different colors of polish or can content, depending on which button, 26 or 28, is pushed. In the simplified version of the machine, the polish can be sprayed manually on the buffing means, thereby eliminating the mixing assembly 46. Alternatively, the desired polish or other such means is applied on the shoe before introducing into the machine.

Figure 7:
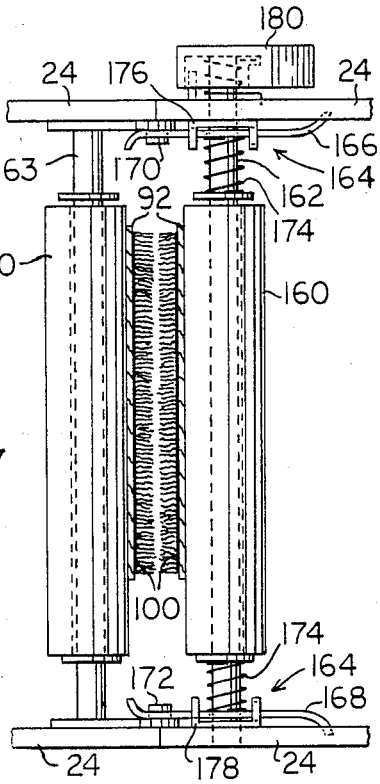
FIG. 7 is an end view in elevation of the roller supports for the buff assembly as well as the lock assembly in the buffing position.
Figure 8:
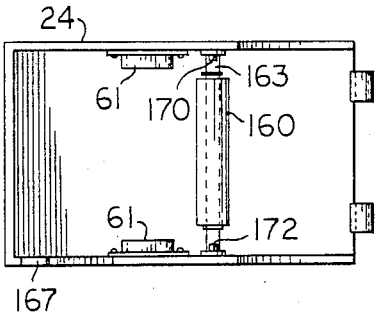
FIG. 8 is an elevation view of one of the doors.

Means are provided for normally biasing the doors 24 to an open position. Referring to FIG. 2, such means is in the form of a torsional spring 156 mounted on the door pivot post 158. Referring to FIGS. 7 and 8, roller 160 is provided on the inside of each door 24 in such a position as to wrap the pad arms 92 of support pad 88 around both sides of the back of the shoe and wrappingly support the arms 92 as the buffing means assembly is vibrated. The rollers 160 are mounted for rotary motion on roller support pins 162 and 163 provided in the doors 24. As seen in FIGS. 6 and 7, when the doors are closed, the buffing means 100 is brought into close contact with the back of the fixed heel stop 120. Each of the doors 24 is restrained from moving towards the other past the intended middle position by the tab 165 attached to the base 14 engaging the notch 167 on the door.

Means can be provided on the pins 162 and 163 for locking the doors 24 in the closed position. Such means is in the form of a spring biased cam actuated latch assembly 164. The latch assembly includes latch plates 166 and 168 at the top and bottom of pins 162 which are biased into engagement with tabs 170 and 172 respectively by springs 174. Cam release plates 176 and 178 are mounted to rotate with pin 162 to release the latch plates 166 and 168 from the tabs 170 and 172, respectively. The pin 162 is rotated by means of a spring-returned release knob 180 mounted at the top end of the pin 162 outside door 24. Rotation of the knob 180 through 90° will move the cam of the release plates 176 and 178 behind the latch plates 166 and 168, respectively, forcing the latch plates away from the tabs, 170 and 172, respectively. On release of the latch lock, the doors will open due to the bias of springs 156. It should be noted that the latch plates are curved at the locking ends so that the tabs 170 and 172 will cam the plates inward against the bias of springs 174 to reengage the tabs as the doors 24 are closed. In a closed position, the separating force through the latch assembly 164 is directly transmitted to pins 162 and 163. Provisions are provided for constant engagement of the nonlocking ends of the latch plates 166 and 168 with the door 24 so as to prevent rotation of the plates 166 and 168 about the pin 162. Also, provision is provided on each of the cam plates 176 and 178 to prevent the nonlocking ends raising off the door 24. It should be understood that the doors 24 are simply frame means for operatively supporting the guides 61, the pins 162 and 163, and the lock assembly 164, modified to include closing and opening functions of the door.

Figure 10:
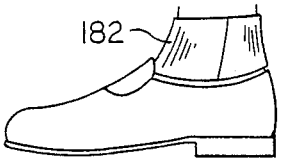
FIG. 10 is a side view of the sock protector mounted on ankle above the shoe.
Figure 9:
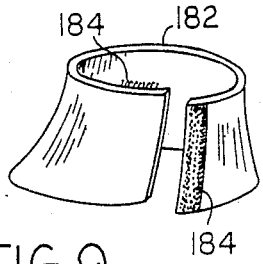
FIG. 9 is a perspective view of the sock protector.

Means can be provided to protect the sock of the user when the shoe is being polished while worn on foot. Such sock protector means is in the form of a flexible collar 182 (FIG. 9) having a configuration conforming to the ankle of the user and thickness comparable to that of shoe upper. A pressure responsive stop lock 184 such as VELCRO is provided towards the ends of the collar for easy attachment when placed on the ankle as seen in FIG. 10. While using the machine, the buffing means 100 forms a bridge between the shoe and the sock protector 182 thereby protecting the sock from polish stain.

An obvious modification (not shown) of the machine described in the above embodiment is to reverse from a buffing means vibrating system to a shoe vibrating system. In the shoe vibrating system, the adjustable heel stop assembly 116 and the fixed heel stop 120 will be attached to the vibrating element 50, and the pad arms 92 of the support pad 88 will be attached to stationary supports on the doors 24. The length adjuster spring 112 will be connected to a post fixed on the base structure. In place of the support rollers 160, an elastic means mounted on each door 24 which will engagingly support the arms 92 of the pad 88 so as to maintain contact between the buffing means and the back of the shoe as the shoe vibrates, can be provided. It is to be noted that the buff assembley 20, the support pad 88 and the buffing means 100 are flexible in that they can deflect in different directions at various points of the body by displacement to follow the shoe shape. Furhter, in either of the systems where the buff assembly vibrates or the shoe support vibrates during buffing, the buff assembly experiences alternately a backward pulling force at the rear and a forward pulling force on ring 114 at the front. Reference to enclosing a shoe or contact with the shoe surface refers generally to polishable areas of the shoe above the sole.

The shoe buffing machine can easily be converted into a foot massage machine by replacing the buff assembly 20 by a massage assembly similar in form to the buff assembly 20, except that the buffing means is replaced by a foot massage means in the form of a massage pad to enclose a foot. The user in this case can wear a slipper-like base for supporting the foot in the shoe positioning assembly.

A number of variations or improvements of the foregoing embodiments are possible without departing from the scope of the invention, some of which are as follows:

It is possible that the arms 54 of the vibrating assembly 32 be coincidentally pivoted at the end of the vibrating element 50 (FIG. 3) in which case, for easy opening of the doors 24, the vibrating element 50 can be extended under the heel of the shoe. In this case, the arms 54 can be kept locked during the buffing operation or the post assemblies 60 can be solely supported by the guides 61 in the doors 24 to withstand the separating force of the arms 54.

The length adjuster spring 112 can be connected to a post fixed on the base structure instead of the vibrating element 50 in which case the spring force of spring 112 will provide the forward motion of the buff assembly as the element 50 vibrates. Still further, the length adjuster spring 112 can be replaced by a nonelastic member although it will limit the size range of shoe that can be buffed in one buff assembly 20.

It is also possible to make the buffing cloth 100 and the support pad 88 into one unit. A variety of attaching means for the arms 92 of the pad 88 different from the pins and the tubular section approach can be used. The support rollers can be replaced by stationary means, but it can shorten the life of the support pad 88. The support rollers 160 can be so placed as to only partially cover the rear of the shoe by the buff assembly 20. The operating handle 36 can be provided with means for simultaneously closing or opening of the doors 24 as the toe raising roller 130 is actuated, and for actuating the motor switch. The shoe raising roller mechanism can be eliminated and instead the shoe can be pushed into the buff assembly against the bias of the springs 80 where the springs 80 are originally installed somewhat tight. The frame 76 used for anchoring springs 80 can be arranged to vibrate with the buff assembly 20. Post assemblies 60 can be supported in the doors 24 independently of the arms 54 and an extension of the vibrating element 50 can be used to engage the post assemblies 60 only when the doors are in a closed position. The machine can be made such that all the required components of the machine are not supported on the same structure, but on different structures operably coming together to buff the shoe such as the shoe support is fixed on the floor and rest of the assembly is mounted on a vertical wall so that the buff assembly is actuated to enclose a shoe placed on the shoe support.

Figure 14:
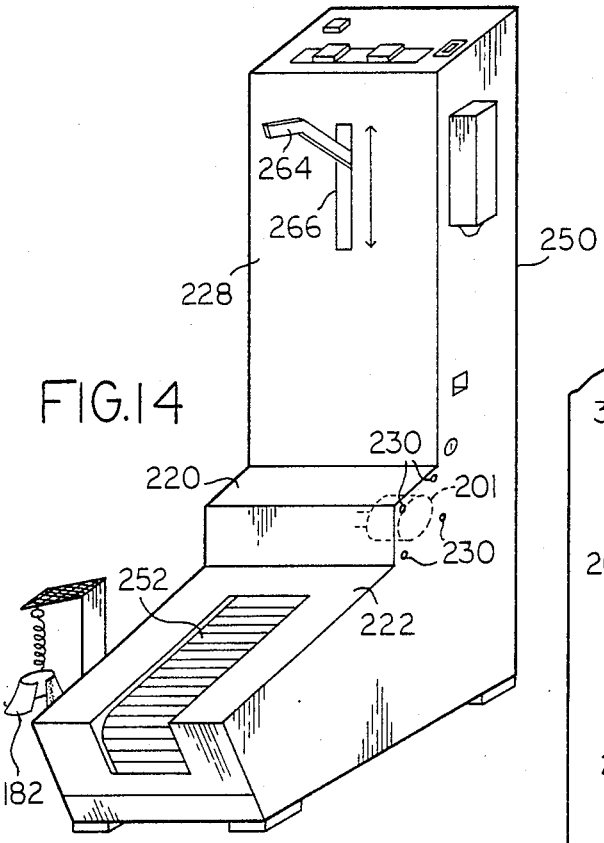
FIG. 14 is a perspective view of the buffing machine adapted for coin controlled operation.
Figure 15:
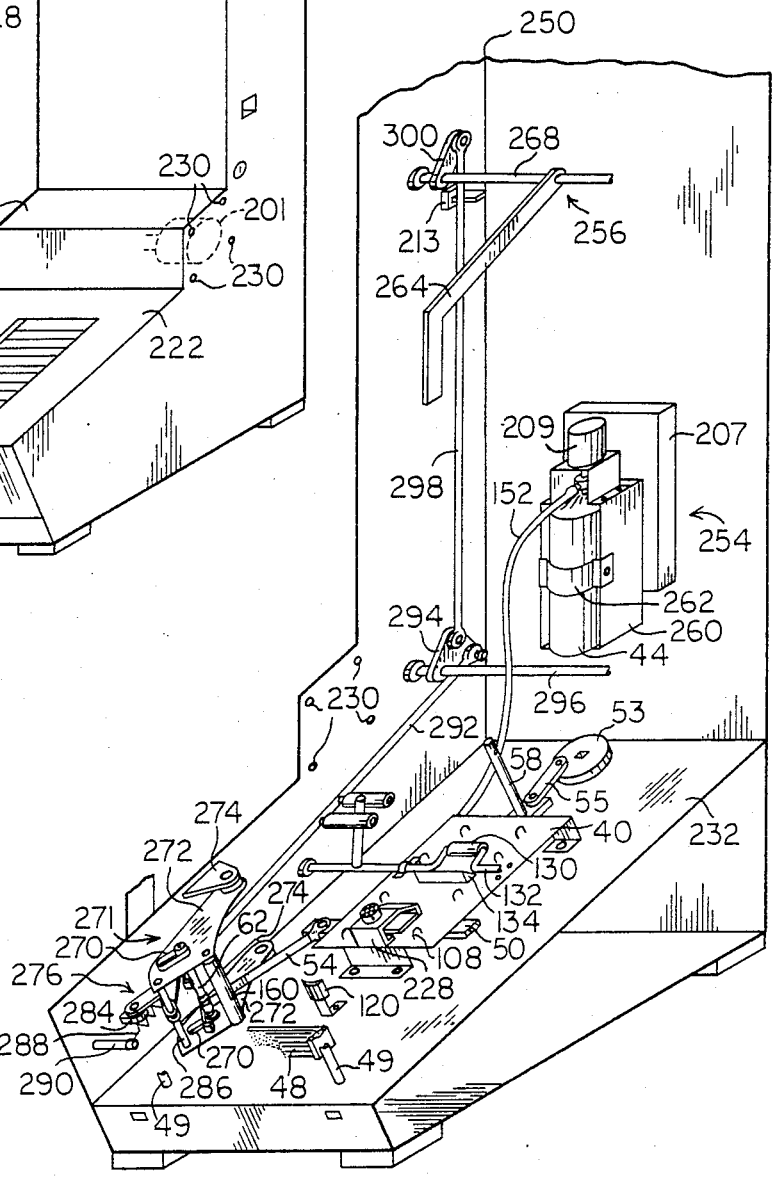
FIG. 15 is a perspective view of coin controlled buffing machine showing a portion of the operating mechanism.

Referring to FIGS. 14 and 15, the machine described above for automatic coin controlled operation is shown. In this embodiment of the invention, an electrical circuit as seen in FIG. 16 is used to control the operation of the shoe buffing machine. The buffing machine is enclosed in a housing 250. An opening is provided in panel 222 for introducing the shoe into the shoe buff assembly. The opening is opened and closed by means of a rolling door 252 which is operated by means of a motor 201 mounted within the rolling door assembly 220 mounted on the side walls of the housing 250 at mounting points 230. This is a conventional rolling door assembly. As seen in FIG. 17, the pivotally mounted panel 222 supports the side guides 224 for the rolling door and is kept locked to the rolling door assembly 220 by two latch locks 226 on either side of the guides 224. After rolling up the door 252 and unlocking the locks 226, the panel 222 can be swung open for replacing worn out buffing means. The front vertical panel 228 can be opened with a key for servicing the machine.

As seen in FIG. 15, the like parts of the buffing machine which are the same as those described above in the household type machine are indicated with the same numbers. Referring to FIG. 15, mechanical parts not shown on the right side are symmetrical with those shown on the left about the central vertical plane of the machine. In order to automate the machine an alternate form of polish mixing assembly 254 is shown mounted on the back wall of the housing 250 and a handle operated linkage 256 is provided for opening and closing the arms 54 to open and close the buff assembly. In this regard, the shoe polish mixing assembly 254 includes a conventional electromechanical actuator 207 mounted on the back wall with a can holder 260 secured to the actuating arm of the actuator 207. A variety of actuators adapted for this kind of application made by many manufacturers are available in the market and one of these manufacturers is Industrial Devices Corporation in U.S.A. The can holder includes a strap 262 for holding the can in position in the holder. The can is shaken by the actuator 207 thereby mixing the content, and the nozzle is operated by means of a conventional solenoid 209 supported by the holder 260. The handle linkage assembly 256 includes a handle 264 which projects outward through a slot 266 in the front panel 228 of the housing. The handle is secured to a bar 268 which is mounted for pivotal motion within the housing. Referring to left side of the machine about the vertical central plane as seen in FIG. 15, the buff assembly 20 (not shown in FIG. 15) as previously described has been secured to a post 62 mounted on the end of the arm 54 and is wrappingly supported by a roller 160 supported on frame 271. The post 62 is positioned in guides 270 provided in arms 272 of frame 271 pivotally mounted on brackets 274 within the housing. The frame 271 is opened and closed by means of a linkage 276 shown in FIG. 18.

In this regard, the linkage 276 includes two links 278 and 280 connected and adapted to be locked in the closed position of frame 271 by mutual engagement of their recessed edges as seen in FIG. 18. The link 278 is connected to a wall bracket 284 mounted on the side wall of the housing. The link 280 is pivotally connected to the member 286 supported between the arms 272 of frame 271. The linkage 276 is biased to an open position by means of a spring 288 connected to the pin 282 and to a post 290 mounted on the side wall of the housing. The frame 271 is pivoted to open the buff assembly towards the side walls by means of the linkage connected to the handle 264. This linkage includes a rod 292 connected to the pin 282 and a link 294 mounted for pivotal motion on a bar 296, and a rod 298 connected to link 294 and a link 300 secured to the bar 268. The bars 268 and 296 are rotatably mounted at their ends in bearings on the side walls of the housing 250. When the handle 264 is pulled down, links 300 and 294 rotate with the handle to pull the bar 292 toward the back wall pulling the pin 282 against the bias of the spring 288. The frame 271 will swing toward the side wall of the housing to open the shoe buff assembly. The switch 213 mounted on the side wall of the housing and actuated by the link 300 senses the open and closed positions of the buff assembly. In FIG. 15, the frame 271 and linkages with the handle 264 are shown in the position where the buff assembly has been opened. The force of the spring 288 keeps the buff assembly in a normally closed position. The buff motor 34 is mounted below the base panel 232 with the shaft coming out through an opening in the panel 232 to connect with disc 53. The shoe support 228 carries the spray head 234 which also actuates the shoe sensing switch 212 by up and down motion as the shoe is removed and placed as seen in FIG. 19. The toe raising roller 130 is actuated by rod 132 rotatably supported at its ends in bearings on the side walls of the buffing machine. An extension from rod 132 which engages two rollers supported by two extensions from rod 292 actuates the roller 130 as the rod 292 moves forward and backward during closing and opening of frame 271. The sock protector 182 is connected by a flexible cord to a foot rest mounted on the housing 250 as seen in FIG. 14. Disposable type sock protectors also can be provided on the housing.

Referring to FIG. 16, a circuit is shown for automatically operating the shoe buffing machine shown in FIGS. 14 and 15. As seen in FIG. 16, a stepping switch 190 is shown connected across power lines 192 by lines 194 and 196. The switch includes seventeen steps which are actuated in 180° of movement of the stepping switch 190. The switch is actuated by a stepping coil 195 connected across the lines 196 and 198; the line 198 being connected through the switch circuit to the switch 190. In the position shown in FIG. 16, the switch is in the start position with the switch 190 through contact A connected across the lines 192 through a lamp 199. The lamp 199 lights up an instruction "Put coin in machine." Dropping prescribed amount of coins into the machine through the coin slot closes switch 200, actuating the stepping coil 195 to move the switch 190 to contact B to complete the circuit through the door motor 201. Obviously, the machine can be adapted to start the operating cycle by means other than coins such as tokens, magnetic cards, etc. The door motor opens the door 252. As the door 252 reaches the full open position, actuated by the door in a sequence switch 202 opens to turn off the motor 201, switch 204 closes to actuate the stepping coil 195 and switch 202 transfers to make contact for reversal of direction of rotation of door motor 201 for closing the door in a following step operation of the switch 190. The switch 190 moves to contact C closing the circuit through lamp 205 lighting up an instruction "Press to apply polish" on a button.

Pushing this polish button closes switch 206 to actuate the stepping coil 195 and move the switch to the contact D. The circuit through the actuator 207 is closed to shake the polish can 44. A time delay switch 208 opens, stopping the actuator 207 and connecting the switch 190 to line 198 to actuate the stepping coil 195 to advance the switch to the contact E. Switch 190 will then close the circuit through the solenoid 209 actuating the nozzle on the spray can to spray polish on the buff assembly through the spray head 234. The normally closed time delay switch 210 opens the circuit through the solenoid to stop the spray of polish and closes the circuit through line 198 to the stepping coil 195, advancing the switch 190 to the contact F. The circuit through the lamp 211 closes lighting up the signal "Wear sock protector, Open machine lowering handle, Introduce shoe through brushes past Stop, Close machine raising handle." When the machine is in a closed position, the switch 213 is in a closed position. When the machine is opened, switch 213 opens. As the shoe is placed in position for buffing, the switch 212, and as the machine is closed, the switch 213, close the circuit actuating stepping coil 195 to move the switch 190 to contact G. This closes the circuit through lamp 217 lighting up the instruction "Press to shine" on a button. On pressing this shine button, switch 214 closes operating the stepping coil 195 to move the switch 190 to the contact H. This closes the circuit to the buff motor 34 which then vibrates the buff assembly 20 to shine the shoe. A normally closed time delay switch 216 will then open, stopping the buff motor and closing the circuit to the stepping coil 195 to advance the switch 190 to the contact I. Then lamp 218 lights up instruction "Open machine, Remove shoe, Release the handle." When the machine is opened, switch 213 opens. It is to be noted that opening and closing of machine refers to opening and closing of buff assembly and not rolling door. When the shoe is removed the switch 212, and as the machine closes on releasing handle 264 the switch 213 close the circuit to actuate the stepping coil 195 to advance the switch 190 to contact J. This starts the cycle of operation for the second shoe. The stepping switch 190 advances eventually to contact Q through contacts K, L, M, N, O and P as the buffing cycle for the second shoe is completed, and this closes the circuit through the door motor 201 to close the rolling door 252. Towards the end of closing, actuated by the rolling door, in a sequence the switch 202 opens to turn the door motor 201 off, the switch 204 closes to actuate the stepping coil 195, and the switch 202 transfers to original position ready for starting the motor 201 for opening the rolling door on subsequent coin insertion. The stepping switch 190 now completes the circuit through contact A lighting up the sign "Put coin in machine" leaving the machine ready for another user.

The complete cycle including opening and closing the buff assembly, application of polish, raising the toe of the shoe and buffing can be made completely automatic using actuators or other means. While this embodiment presents one way of automating the buffing machine for public use, many other ways are possible.

While the above description contains many specificities, these should not be construed as limitations on the scope of the invention, but rather as an exemplification of preferred embodiments thereof. Many other variations are possible. Accordingly, the scope of the invention should be determined not by the embodiments illustrated, but by the appended claims and their legal equivalents.

The embodiments of the invention in which an exclusive property or privilege is claimed, are defined as follows:

1. A shoe buffing machine comprising a base structure, a shoe buff member shaped to at least partially enclose a shoe, means supporting said buff member on said base structure, a shoe support located on said base structure in a position to support a shoe inserted into said buff member, drive means operatively connected to vibrate at least one of said supporting means and said shoe support whereby a shoe placed in said buff member on said shoe support is buffed by the relative motion of said support means with respect to said shoe support, and means mounted on said base structure for applying shoe conditioning preparation to said buff member wherein said applying means comprises a bracket mounted on said base structure, a container holder pivotally mounted on said bracket,
button means for rotating said holder to mix the content of said container, and
actuating means for actuating the nozzle on said container on rotary movement of said holder in said bracket.

2. The buffing machine according to claim 1 including
a spray nozzle located inside of said buff member, said nozzle being connected to said container whereby said preparation is sprayed on the interior of said buff member on actuating of the nozzle in said container.

3. A shoe buffing machine comprising
a base structure,
a shoe buff member shaped to at least partially enclose a shoe,
said buff member including a support pad and a buffing means mounted within said support pad
said support pad being shaped to enclose the toe of a shoe and having rearwardly extending elongated ends shapted to enclose the rear portions of a shoe,
means supporting said buff member on said base structure,
means for maintaining said buffing means on the elongated ends of the support pad in engagement with the rear of the shoe, wherein said maintaining means is mounted on a pair of doors mounted on said base structure for supporting said ends of said pad to engage the buffing means on the rear portion of shoe during buffing operation,
a shoe support located on said base structure in a position to support a shoe inserted into said buff member, and
drive means operatively connected to vibrate at least one of said supporting means and said shoe support whereby a shoe placed in said buff member on said shoe support is buffed by the relative motion of said support means with respect to said shoe support.

4. A shoe buffing machine comprising
a base structure,
a shoe support located on said base structure in a position to support a shoe,
a shoe buff member having a forward portion adapted to engagingly enclose the front portion of a shoe and
two elongated ends extending rearwardly from said forward portion to enclose the rear portion of a shoe,
means supporting said buff member on said base structure,
a pair of doors pivotally mounted on said base structure, each of said doors including means for engaging said elongated ends of said buff member for opening and closing said ends with respect to the shoe on said shoe support by the motion of said doors, and
drive means operatively connected to vibrate at least one of said supporting means and said shoe support whereby a shoe placed in said buff member on said shoe support is buffed by the relative motion of said support means with respect to said shoe support.

5. The buffing machine according to claim 4 wherein said supporting means includes a frame having a pair of arms pivotally mounted thereon, and
a post assembly mounted at the outer end of each of said arms operatively connected to said elongated ends of the buff member whereby said ends can be moved to open and close with respect to a shoe on the shoe support, said arms being pivotable about pivots located away from and on either side of the middle of said frame for resisting the force exerted by said elongated ends of the buff member on said arms by virture of the induced opposing thrust between said post assemblies through their mutual contacts.

6. A shoe buffing machine comprising
a base structure,
a shoe buff member shaped to at least partially enclose a shoe,
means of supporting said buff member on said base structure,
a shoe support located on said base structure in a position to support a shoe inserted into said buff member,
said buff member including a support pad shaped to enclose the toe of a shoe and having rearwardly extending elongated ends,
means for attaching the elongated ends of the pad to said support means,
a buffing means supported on the interior of said pad,
drive means operatively connected to vibrate at least one of said support means, and said shoe support whereby a shoe placed in said buff member on said shoe support is buffed by the relative motion of said support means with respect to said shoe support,
said supporting means including a vibrating frame, having a pair of arms pivotally mounted thereon, and a post assembly mounted at the outer end of each of the arms, said post assemblies being operatively connected to said attaching means, whereby the elongated ends of the said pad can be moved to open or close with respect to a shoe on the shoe support, and
a pair of doors mounted on said base structure,
each of said doors including guide means operatively engaging said post assemblies whereby said elongated ends of said pad are opened or closed by the motion of the doors.

7. The buffing machine according to claim 6 including means biasing said doors to a normally open position, and
lock means for holding said doors in the closed position.

8. The buffing machine according to claim 7 including
roller support pins mounted on said doors and a roller on each of said pins to support said ends of the pad to engage the buffing means at the rear portion of said shoe during buffing operation, and wherein the said lock means are mounted on said pins to prevent separation of the pins due to the separating force transmitted to the pins by the buffing motion of the buff member and including means for releasing said lock means by actuation of one of said roller support pins.

9. A shoe buffing machine comprising
base structure,
a shoe buff member shaped to at least partially enclose a shoe,
means supporting said buff member on said base structure, a shoe support located on said base structure in a position to support a shoe inserted into said buff member,
said shoe support including a shoe positioning assembly comprising a fixed heel stop mounted on said base structure, an adjustable heel stop mounted on said base structure to accommodate various size heels whereby a shoe is positioned independently inside the said buff member, the shoe being held by said fixed heel stop and said adjustable heel stop so as to facilitate relative vibratory motion between the shoe and the said buff member during the buffing operation, and drive means operatively connected to vibrate at least one of said supporting means and said shoe support whereby a shoe placed in said buff member on said shoe support is buffed by the relative motion of said support means with respect to said shoe support.

10. The buffing maching according to claim 9 wherein said adjustable heel stop is biased toward said fixed heel stop and including means for locking said adjustable heel stop at desired locations.

* * * * *